United States Patent [19]

Dix et al.

[11] 4,020,273

[45] Apr. 26, 1977

[54] VERTICAL PYROLYSIS FURNACE FOR USE IN THE PRODUCTION OF CARBON FIBERS

[75] Inventors: Robert Dix, Wayne, N.J.; Richard F. Markel, Greenville, S.C.; James A. Parker, Charlotte, N.C.; John P. Riggs, New Providence; Dale T. Vest, Summit, both of N.J.

[73] Assignee: Celanese Corporation, New York, N.Y.

[22] Filed: Nov. 26, 1975

[21] Appl. No.: 635,515

[52] U.S. Cl. ..... 13/7; 13/22; 23/277 R; 219/388

[51] Int. Cl.[2] ..... H05B 3/00

[58] Field of Search ..... 13/20, 7, 22, 24, 25, 13/31; 252/42; 23/277; 219/388, 390, 393, 397, 398, 407, 534, 352

[56] References Cited

UNITED STATES PATENTS

| | | | |
|---|---|---|---|
| 3,311,694 | 3/1967 | Lasch, Jr. | 13/24 |
| 3,404,210 | 10/1968 | Weber | 13/22 |
| 3,578,069 | 5/1971 | Morel et al. | 13/7 |
| 3,641,249 | 2/1972 | Higgins | 13/22 |

*Primary Examiner*—R. N. Envall, Jr.

[57] ABSTRACT

A vertical pyrolysis furnace used in the carbonization or high temperature heat treatment of a continuous length of organic fibrous material is disclosed. The oven includes a central conduit or passage having a plurality of independently controlled heating zones disposed circumferentially therearound and spaced axially therealong. The conduit and heating elements are surrounded by suitable insulating material and a gas-tight shell. At the top of the furnace an exhaust manifold is provided which communicates with the central conduit. An environmental seal is provided at the upper end of the exhaust manifold and at the bottom of the conduit. Suitable gaseous inlets communicate with the furnace for an inert gaseous atmosphere which is controlled such that free convection causes the gaseous atmosphere to rise vertically through the central conduit to the exhaust chamber located at the upper end thereof. A continuous length of organic fibrous material moves vertically downwardly through the central conduit from the upper environmental seal to the lower environmental seal. The independently controlled heating zones provide a vertically downwardly increasing temperature gradient, up to a desired maximum value which extends over a prescribed length, which drives off toxic gaseous by-products from the continuous length of organic fibrous material. The heating zone placement and lower environmental seal permit the continuous length of organic fibrous material to cool substantially before exiting to the atmosphere.

15 Claims, 7 Drawing Figures

VERTICAL PYROLYSIS FURNACE FOR USE IN THE PRODUCTION OF CARBON FIBERS

BACKGROUND OF THE INVENTION

The invention relates generally to apparatus for the carbonization of a continuous length of organic fibrous material. More specifically, the invention relates to a vertical pyrolysis furnace for use in carbonization apparatus wherein a continuous length of stabilized fibrous material moves downwardly through the pyrolysis furnace and gaseous by-products of the pyrolysis process move vertically upwardly through the furnace, under the influence of free convection and, if desired, an imposed pressure gradient, to exit the furnace for subsequent treatment and disposal.

In the past, it has been known to graphitize continuous lengths of organic fibrous material by the sequential steps of stabilization, pyrolysis and graphitization. Typically, stabilization of an organic fibrous material renders the same non-burning when subjected to an ordinary match flame and capable of undergoing carbonization without substantial loss of its original fibrous configuration. The stabilized fibrous material is subsequently passed through a pyrolysis operation (i.e., a carbonization operation) wherein elements present therein other than carbon are substantially expelled. Subsequent to the pyrolysis operation, a graphitization step may occur in which the X-ray diffraction pattern of the fiber is changed from a generally amorphous carbon pattern to a predominately graphitic carbon pattern. Significant decomposition during pyrolysis occurs at temperatures in the range of 400° to 1000° C. with appreciable devolatilization occurring up to about 1500° C.; whereas the graphitization step occurs in the neighborhood of 2000° C. or higher.

Most known apparatus for the production of graphitized fibers includes a horizontally disposed pyrolysis oven. Such horizontally disposed furnaces, however, are subject to numerous disadvantages. For example, suitable tension must be applied to a continuous length of fibrous material passing through a horizontal pyrolysis oven in order to compensate for the classical catenary effect. In addition, mechanical devices are often provided to specifically accommodate for a catenary tendency of a continuous length of fibrous material. Another disadvantage of horizontal pyrolysis ovens concerns the presence of an increased concentration of gaseous by-products. Since the presence of such gaseous by-products has a tendency to inhibit the efficiency with which additional gaseous by-products are thermally driven from the fibrous material, increased concentrations thereof are counter productive in the pyrolysis environment.

Other difficulties with horizontal ovens relate to the ability to provide a controlled temperature gradient axially therealong. A gradually increasing temperature gradient is desirable since increased amounts of gaseous by-products are released as the temperature level of the fibrous material is increased to the vicinity of 1000° C.

With horizontal ovens, the condensation of gaseous by-products on cooler portions of the furnace creates an undesirable build-up of residue which can snag fibrous material passing therethrough or otherwise interfere with efficient operations. Moreover, the removal and treatment of toxic gaseous by-products present further difficulties in horizontal ovens since there is no preferred location to which the gases migrate for efficient collection and exhaustion. The foregoing lack of effective off-gas isolation to a non-deleterious temperature regime and lack of minimization of off-gas concentration severely limits the attainable mass throughput of fibrous material and, consequently, limits the process economics.

During pyrolysis, concentrations of gaseous off-products have a tendency to attack and corrode a continuous length of fibrous material from which they evolved unless they are promptly removed. This corrosion is aggravated by the presence of a hot environment and can cause significant strength reductions. With horizontal furnaces, it is therefore necessary to continuously force a purge gas through the furnace to sweep the off-products away. Since the purge gas thus needs pumping, frequently a turbulent flow regime exists which has a tendency in itself to accelerate the corrosion as well as to sharply limit process economics.

As a result of the catenary shape assumed by a continuous length of fibrous material as it traverses a horizontal pyrolysis furnace, the lateral dimensions of the furnace passageway must be sized to accommodate variable vertical sagging distances which result with changes in tension on the continuous length of fibrous material.

With the current emphasis on efficient utilization of available space, it will also be apparent that horizontal furnaces are generally undesirable. Moreover, since cost economies result from increased fibrous material line speed and since the line speed may be increased when the longitudinal dimension of a pyrolysis furnace increases, the value of an alternative to horizontal furnaces is even more clearly apparent.

We also note that horizontal furnaces are difficult to string up with a continuous length of fibrous material because limber fibrous material does not transmit compressive forces required to push it through a horizontal passageway.

Another problematic aspect of horizontal furnaces concerns the simultaneous processing of several continuous lengths of fibrous material. More specifically, interference between the continuous lengths themselves as well as with the gaseous off-products are undesirable.

A vertically disposed pyrolysis furnace having a pair of parallel upright walls each of which is provided with heating elements and between which a supply of fibrous carbonaceous material is passed vertically upwardly is known in the art. See, for example, U.S. Pat. No. 3,849,332 issued to Bailey et al. on Nov. 19, 1974. Such a device, however, does not permit a multizone heating system that establishes a means for a temperature gradient. In addition, there is no means for preventing contamination of an environment with the toxic gaseous off-products. Moreover, the vertical oven of the Bailey et al. apparatus does not permit the establishment of a concentration gradient for gaseous off-products which decreases as fibrous material advances through the furnace and which sweeps itself toward the exhaust.

The foregoing deficiencies of Bailey et al are further compounded by the furnace enclosure which necessitates semicontinuous operation and by the floor exhaust port. The exhaust port location of Baley et al is not conducive to efficient removal of the off-gases by virtue of their relative buoyancy. Moreover, the off-gas concentration would be such that primarily low temperature operation would be dictated in order to prevent the off-gas from attacking the product being treated.

In one attempt to prevent the condensation and deposition of product gases, such as sodium, on the walls of a pyrolysis furnace, a counter flowing inert gaseous atmosphere is provided in the relatively hot portion of a pyrolysis furnace. A suitable exhausting means is provided with its separate heater to prevent exhaust gases from condensing thereon during their extraction or removal from the hot zone of the furnace. See, for example, British Pat. No. 1,284,399 issued to Courtalds Ltd., Aug. 9, 1972. Such an apparatus does not, however, provide an inherent means of preventing the condensation of gaseous products in the inlet portion of the pyrolysis device where wall surfaces are relatively cool and condensation tends to become a serious problem. In addition, no axially spaced heating zones are provided that enable a temperature gradient to be maintained during continuous operation.

While condensation of metals, such as sodium treated by the Courtalds Ltd. patent, is a known problem in carbonization at temperatures greater than 1000° C., it has not been found to be an important problem for temperatures less than 1200° C.

SUMMARY OF THE INVENTION

It should now be apparent that there exists a need for a pyrolysis furnace which overcomes problems of the type noted above. It is therefore a general object of the present invention to provide a vertical pyrolysis oven which overcomes problems mentioned heretofore, among others.

A more specific object of the present invention is to provide a novel pyrolysis oven which includes a plurality of independently controlled, axially spaced heating zones that enable a vertically downwardly increasing temperature profile to be provided for a continuous length of stabilized fibrous material which moves vertically downwardly through the oven.

Another object of the present invention is to provide a novel pyrolysis furnace in which free convection is used to sweep an inert atmosphere and entrained gaseous off-products in countercurrent relationship to a continuous length of stabilized fibrous material passing vertically downwardly through the oven such that the continuous length of fibrous material encounters a decreasing concentration gradient of off-product gases as it passes through the oven and such that a laminar flow regime is maintained in the oven.

Another object of the present invention is to provide a novel pyrolysis furnace which can easily and conveniently be strung with a continuous length of fibrous organic material even though the furnace is at its operating temperature.

A further object of the present invention is to provide a novel pyrolysis furnace which is vertically disposed to eliminate the need for providing catenary control on a continuous length of fibrous material moving therethrough.

Yet another object of the present invention is to provide a novel pyrolysis oven in which a combination of resistance heating elements and radiant heating elements is used to heat a continuous length of fibrous material moving therethrough and to establish a conrolled steady-state thermal gradient through which the continuous length of fibrous material moves.

A yet further object of the present invention is to provide a novel pyrolysis oven in which toxic gaseous off-products are conectively migrated and collected in an exhaust chamber located at one end of the furnace such that condensation thereof on the internal passages of the oven has a minimal effect on the operating efficiency of the oven.

A still futther object of the present invention is to provide a novel pyrolysis oven in which environmental protecting seals are provided at the inlet and the exit to the pyrolysis oven thereby maintaining an inert atmosphere in the oven, preventing the escape of toxic fumes from the oven to the environmental atmosphere and preventing environmental oxygen from contaminating the inert atmosphere existing within the oven.

Another object of the present invention is to provide a novel pyrolysis furnace having substantially improved economics resulting from effective isolation and control of degradative off-gases, temperature profile control and high speed throughput of fibrous material.

A pyrolysis oven according to a preferred embodiment of the invention includes a centrally disposed conduit having an inlet end and an outlet end disposed vertically below the inlet end. Positioned at the inlet end of the conduit is an exhaust chamber having an inlet and an exhaust opening for connection with suitable gaseous by-product treatment apparatus. At the inlet to the exhaust chamber, and at the outlet end of the conduit, a suitable environmental seal is provided to maintain an inert atmosphere internally of the oven, to prevent the escape of toxic fumes and to prevent contamination of the inert atmosphere by oxygen. The environmental seals may be provided with a supply of inert gas which is identical to the inert gaseous atmosphere existing within the oven.

Circumferentially located around the conduit, and spaced axially therealong, are a plurality of independently controlled heating zones that facilitate the creation of a controlled, steady-state temperature gradient. Each heating zone may be provided with a suitable temperature control that maintains the temperature of the heating zone within prescribed tolerances. The temperature control may sense the temperature of the gaseous atmosphere existing within the conduit and surrounding a continuous length of stabilized fibrous material passing downwardly through the oven in order to control the corresponding heating zone. Preferably, the temperature control senses a temperature within the corresponding heating zone between the heat source and the conduit.

A suitable body of insulation surrounds the conduit and the heating zones to diminish the heat loss to the surrounding atmosphere and enhance thermal efficiency of the oven. A gastight shell may be provided around the insulation to further prevent the escape of toxic gaseous off-products to the environmental atmosphere and to prevent infiltration of the environmental atmosphere into the conduit.

During the operation of a vertical pyrolysis oven it may be desirable to supply a portion of an inert sweep atmosphere adjacent the high temperature portion of the oven. Accordingly, the central conduit may be provided with spaced apart lateral openings which communicate with a suitable source of inert gas.

BRIEF DESCRIPTION OF THE DRAWINGS

The above and many other objects of the present invention will be apparent to those skilled in the art when this specification is read in conjunction with the appended drawings wherein like reference numerals have been applied to like elements and wherein.

DESCRIPTION OF A PREFERRED EMBODIMENT

Figure 1:
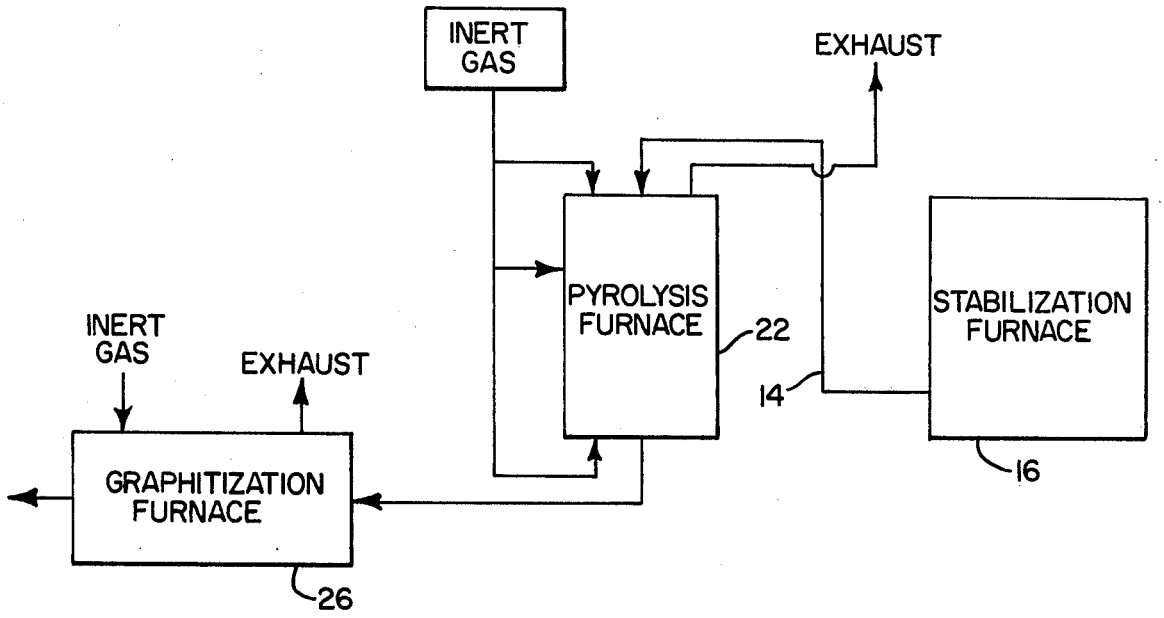
FIG. 1 is a schematic illustration of graphitization apparatus incorporating a vertical pyrolysis oven.

Turnning now to FIG. 1 an overall graphitization aparatus 10 is depicted. In a typical graphitization process, for example, a continuous length of fibrous organic material, such as polyacrylonitrile, releases a substantial quantity of highly toxic gases such as HCN, CO and the like when the fibrous material encounters temperatures in the neighborhood of 400° to 1000° C.

A continuous length of organic fibrous material 14 is ordinarily stabilized in a stabilization furnace 16. In the stabilization furnace organic fibers are rendered capable of undergoing the subsequent pyrolysis without any substantial loss of their original fibrous configuration. In the literature the stabilization step is sometimes referred to as pre-oxidation.

As the continuous length of stabilized fibrous material leaves the oxidation furnace 16, it subsequently enters a vertical pyrolysis furnace 22. As the continuous length of stabilized fibrous material passes through the pyrolysis furnace 22, the elemental carbon content thereof is increased to a level in the neighborhood of 90 to 95% as a result of exposure to temperatures in the vicinity of 1200° C. Substantially higher temperatures, in the range of 1500° to 1800° C. may be used for the manufacture of certain products. A suitable tensioning assembly (not shown) maintains a predetermined amount of tension on the continuous length of fibrous material 14 as it passes through the pyrolysis furnace 22 and serves to improve the physical properties of the fibrous material.

The continuous length of fibrous material 14 leaving the pyrolysis furnace 22 may then be directly packaged for subsequent use as a reinforcing constituent of composite systems or it may be subjected to further processing steps. The further steps may include surface treatment to improve surface adhesion properties, or higher temperature graphitization treatment.

Thus, the continuous length of fibrous material may then pass through a generally horizontal graphitization furnace 26 wherein the elemental carbon content of the continuous length of fibrous material is increased above 45% and as high as 99+% by exposure to temperatures in the range of 1200° to 3000° C. The graphitization furnace 26 is effective to substantially increase the elastic modulus of the fibrous material.

A continuous length of fibrous material suitable for use in this carbonization apparatus may be a yarn or a tow comprising a plurality of fibers arranged in generally parallel relationship with respect to one another. Moreover, a plurality of yarns or tows may comprise the continuous length of fibrous material. The continuous length of fibrous material leaving the graphitization furnace 26 is suitable forsubsequent treatment by other apparatus.

Figure 2:
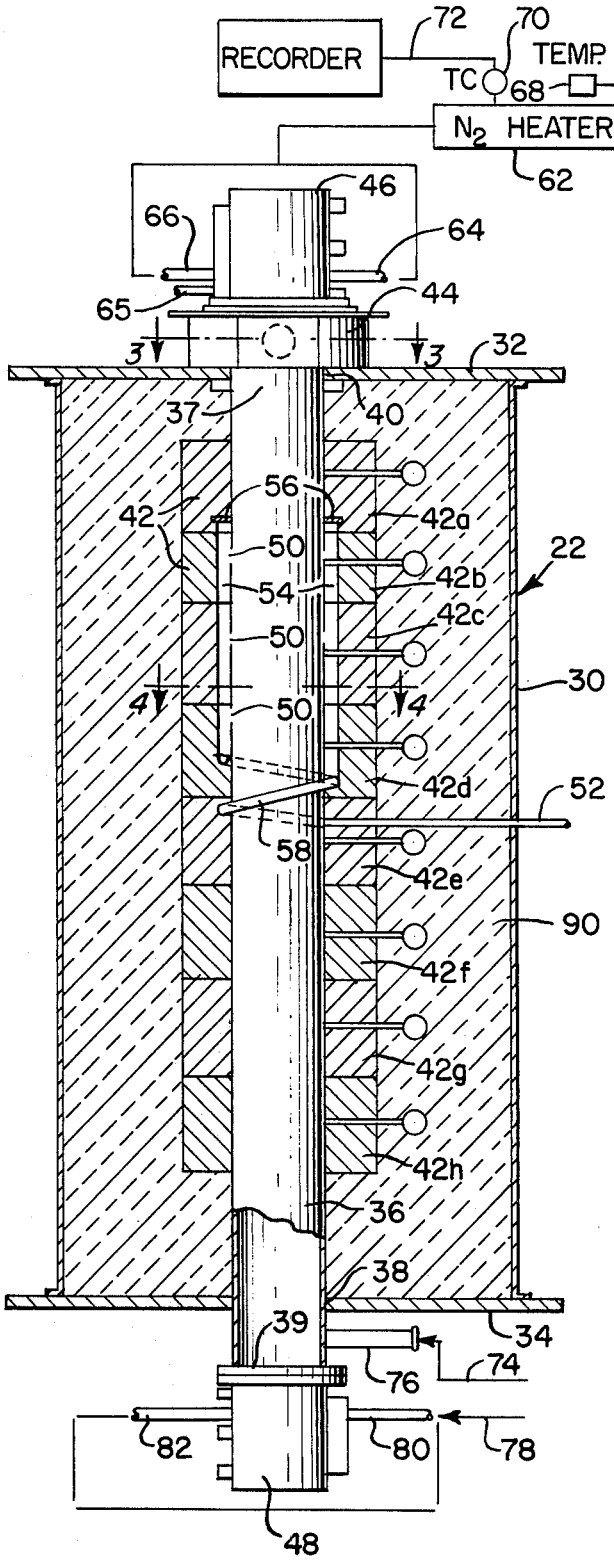
FIG. 2 illustrates a partial cross-sectional view of the vertical pyrolysis oven according to a preferred embodiment of the invention.

Turning now to FIG. 2, the construction of a vertical pyrolysis furnace 22 according to the present invention is clearly illustrated. The pyrolysis furnace 22 is provided with a generally cylindrical shell 30 which may be gas-tight and to which a top member 32 and a bottom member 34 are suitably attached. Generally coaxially disposed with respect to the shell 30 is a central conduit 36 which extends between the top member 32 and the bottom member 34 and provides a passage that is traversed by a continuous length of stabilized fibrous material as it passes through the pyrolysis furnace 22. It will be noted moreover that the conduit 36 extends through an opening 38 provided in the bottom member 34 and is received in an opening 40 provided in the upper member 32. The openings 38, 40 are positioned in alignment with the central axis of the shell 30 and thereby facilitate the positioning of the conduit 36 with respect to the shell 30.

The conduit 36 may be fabricated from metal, graphite, or ceramic material and may be comprised of one or more coaxially aligned longitudinal sections to facilitate maufacture, installation, or shipment. At temperatures of 1200° C. or more, metal would ordinarily not be used. The inlet 37 of the conduit 36 is preferably vertically above the outlet 39 so that a continuous length of fibrous material will pass vertically downwardly therethrough. The internal diameter of the conduit is selected such that it is greater than the greatest lateral dimension of the continuous length of fibrous material passing therethrough. A further consideration in selecting the internal diameter is the possibility of simultaneously processing a plurality of tows. By thus selecting the internal diameter, there is a substantially diminished likelihood that condensation and deposits from gaseous off-products will accumulate a sufficient thickness to interfere with movement of the continuous length of fibrous material through the furnace.

Positioned externally with respect to the central conduit 36 and spaced axially therealong are a plurality of independently controlled heating zones 42. The independently controlled heating zones 42 are selectively adjustable to provide a controlled steady-state temperature gradient which increases vertically downwardly through the central conduit 36. The temperature gradient increases to a maximum temperature which is preferably in the range of 1000° C. to 1800° C. The maximum temperature is maintained constant over an adequate length of the conduit which is consistent with a minimum residence time necessary to assure desired property development. Each heating zone, 42*a* through *h*, may be provided with suitable conventional temperature sensing means, such as a thermocouple, that is operably connected to conventional control circuitry to maintain the temperature of each zone within predetermined allowable limits.

Positioned on the top member 32 of the shell 30 adjacent the projecting end of the conduit means 36 is a suitable exhaust means 44 from which noxious by-products of the pyrolysis furnace are collected and withdrawn to suitable vapor disposal apparatus (not shown). The vapor disposal apparatus may comprise, for example, an impingement trap followed by a burner which renders the off-products innocuous.

On the top of the exhaust means 44 is a suitable environmental control device 46. The environmental control device 46 and a similar environmental control device 48 provided at the bottom end of the pyrolysis furnace 22 are effective to prevent atmospheric gases, especially oxygen, from entering the pyrolysis furnace 52. Moreover, the environmental seal devices 46, 48 are effective to prevent the escape of noxious by-products from the pyrolysis furnace 22 into the surrounding environmental air.

The conduit means 36 may be provided with a plurality of lateral openings 50 axially spaced therealong. The openings 50 may be in fluid communication with a suitable source of an inert gaseous atmosphere 52.

Along each lateral side of the conduit means 36 (see FIG. 2) and superposed with respect to the lateral orifices 50 may be a pair of channel members 54 which may be suitably welded or otherwise secured to the conduit means 36. The channel members 54 may be provided with suitable end closures 56 and communicate at one end with a conduit 58 which is wrapped around the conduit means 36 and which communicate with the source 52 of an inlet gas. By wrapping the conduit 58 around the conduit 36, gas passing through the conduit 58 is heated before it is introduced through the lateral openings 50 without the need for an additional gas heater.

Another source of inert gas 60 may communicate with a suitable gas heater 62 which heats the inert gas for introduction into the upper environmental seal 46 by means of the inlets 64, 66. Suitable temperature controls 68, thermocouples 70 and recorders 72 may be provided for the nitrogen heater 62 as desired to control and make a record of its operation. The heated inert gas in effective to preheat the continuous length of fibrous material as it enters the furnace. In addition, the heated gas inhibits condensation of off-gases on the upper seal 46. Moreover, heated inert gas has a lower density than cool inert gas so that a smaller quantity of heated inert gas is required to effect a given desired pressure differential across the upper seal 46.

A source of inert gas 74 communicates with a conduit 76 that communicates with a lower end of the central conduit means 36. Inert gas may be introduced through the conduit 76 when a strong counter current flow through the conduit is desired. Ordinarily, such a strong counter current flow isn't required.

Inert gas from source 78 communicates with the lower environmental seal 48 and provides a supply of inert gas to the conduits 80, 82 communicating therewith.

Figure 3:
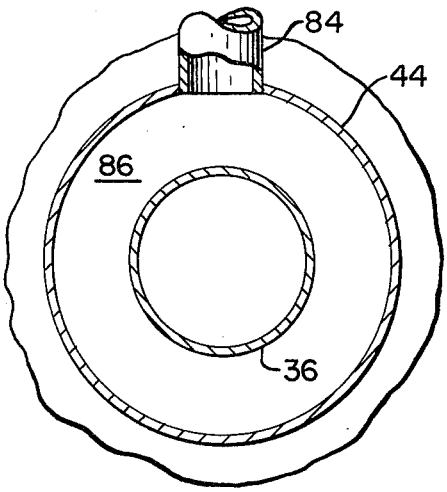
FIG. 3 constitutes a view in partial cross section taken along line 3—3 of FIG. 2 and illustrates a cross section taken through the exhaust chamber.

Turning now to FIG. 3, the spatial relationship between the exhaust chamber 44 and the conduit 36 is illustrated. A suitable opening is provided in the top of the exhaust chamber 44 to permit a continuous length of stabilized fibrous material to enter the pyrolysis furnace and more specifically to enter a conduit means 36. At one side of the exhaust chamber 44, a suitable exhaust conduit 84 is provided through which toxic and corrosive gaseous by-products of the pyrolysis operation are withdrawn for suitable subsequent treatment as discussed above.

The exhaust chamber 44 includes a large internal chamber or cavity 86 which communicates with the upper end of the conduit 36 and receives toxic gaseous off-products therefrom. The cavity has a lateral extent which susbstantially exceeds the internal diameter of the conduit so that tar-like condensates of the off-products, or fibrous residues, that have a tendency to accumulate and to inhibit the movement of a continuous length of fibrous material are maintained at a safe non-interfering distance therefrom. The exhaust chamber 44 may, if desired, be heated or allowed to receive heat from the furnace to further inhibit condensation of off-products.

Figure 4:
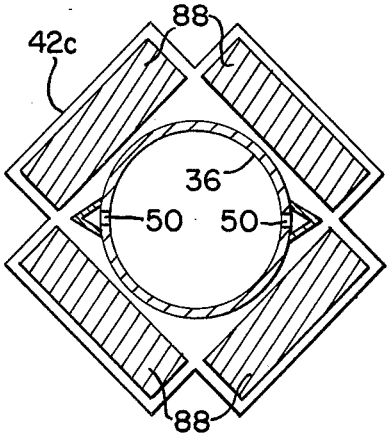
FIG. 4 is a cross-sectional view taken along the line 4—4 of FIG. 2 to illustrate the positioning of resistance heating elements in position around a generally circular conduit.

Each heating zone 42*a* – *h* may comprise, for example, four resistance heating elements 88 (see FIG. 4) which are arranged in a quadrilateral fashion peripherally around the circumference of the conduit 36. The resistance heating element 88 may comprise resistance heaters imbedded in ceramic blocks and facing the conduit 36 for heating the conduit 36 to a predetermined temperature level.

Disposed between the cylindrical shell 30, the top 32, the bottom 34, the conduit 36, and the plurality of heating zones 42 is a suitable insulation material 90. The insulation material is effective to reduce the heat loss from the heating elements 88 to the ambient atmosphere.

Since the details of both the upper and lower environmental seals 46, 48, respectively, are generally the same, it will be necessary only to describe in detail one of the environmental seals. Accordingly, the upper environmental seal 46 (see FIG. 5) includes a fixed lip 94 which is directly attached to the top 32 of the vertical pyrolysis furnace. Hingedly attached to the fixed lip 94 is a movable lip 96. A suitable hinge pin 98 is provided to facilitate relative movement between the movable lip 96 and the fixed lip 94 and to improve accessability to the conduit 36 during cleaning and string-up operations.

Figure 5:
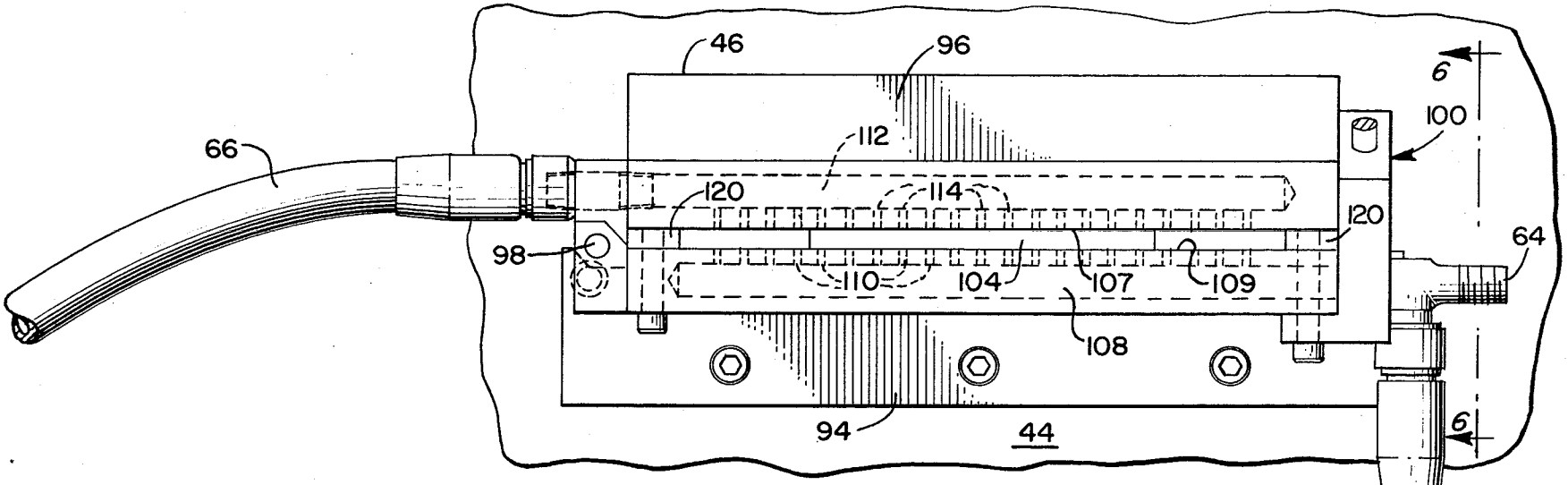
FIG. 5 is an end view of an environmental protecting seal provided at one end of the vertical pyrolysis oven depicted in FIG. 2.

At the lateral side of the environmental seal 46 opposite from the hinge pin 98 is a plurality of latching members 100 (one of which is illustrated in FIG. 5). Each latching member 100 (see FIG. 6) may comprise, for example, an upstanding support 101 carried by the fixed lip 94. Each support 101 may, in turn, include a screw 102 having a suitable turning handle 103 to rotate and thereby advance or retract the screw 102.

As illustrated, each screw 102 is aligned at an angle of about 45° to the corresponding support 101 and is positioned in a portion of the corresponding support 101 which extends beyond the movable lip 96. The movable lip 96 is provided with an outwardly projecting block 105 in general alignment with each of the screws 102. When the movable lip 96 is closed, the screws 102 are advanced into engagement with the blocks 105 to prevent the movable lip 96 from opening relative to the fixed lip 94.

Generally parallel facing surfaces 107, 109 (see FIG. 5) of the movable lip 96 and the fixed lip 94, respectively, define an opening 104 through which a continuous length of stabilized fibrous material passes to enter the vertical pyrolysis furnace. Of course, the corresponding opening of the lower environmental seal 48 provides an egress opening for the continuous length of fibrous material as it leaves the pyrolysis furnace.

The fixed lip 94 is provided with a laterally extending internal manifold 108 having a plurality of transverse discharge ports 110 in communication therewith. The transverse discharge ports 110 communicate with the surface 109 and exhaust inert gas from the supply conduit 64 into the space 104. The movable lip 96 is similarly provided with a laterally extending internal manifold 112 having a plurality of transverse discharge openings 114 that communicate with the surface 107 to supply inert gas from the supply conduit 66 to the space 104.

Figure 6:
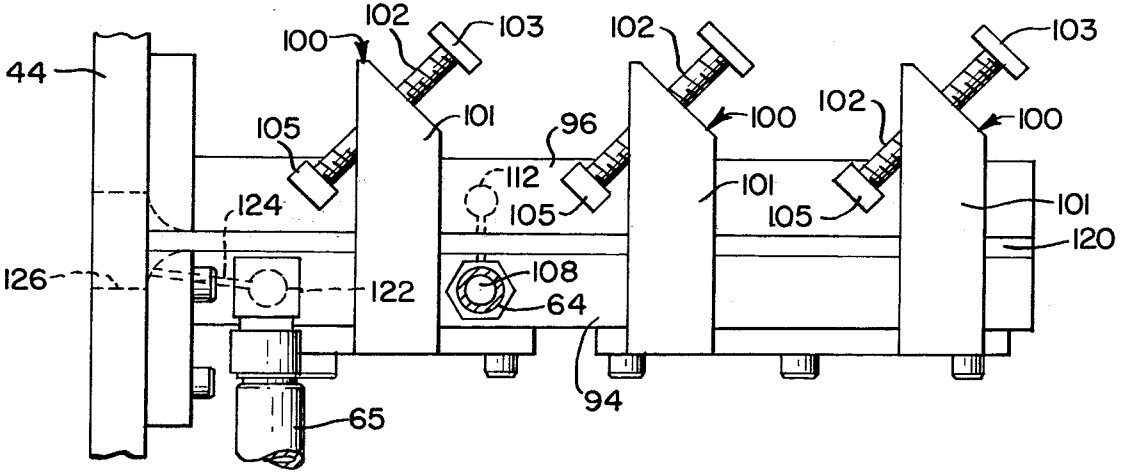
FIG. 6 is an end elevation of the environmental seal of FIG. 5 taken along line 6—6 of FIG. 5.

It will be noted from FIG. 6 that the discharge openings 110, 114 of the fixed lip 94 and the movable lip 96 are in general alignment with one another. In addition, a pair of parallel lateral sealing strips 120 are attached to the fixed lip 94 on the lateral edges of the opening 104. Accordingly, as inert gas floods the opening 104 from the discharge openings 110, 14, atmospheric oxygen is prevented from entering the opening 104 while toxic off-gases from the furnace are prevented from escaping.

From FIG. 6 it will also be seen that the fixed lip 94 also includes a second internal manifold 122 which communicates with the inert gas supply conduit 65. A plurality of discharge openings 124 communicate with the inlet opening 126 of the exhaust chamber 44. In this manner, inert gas can be admitted directly to the exhaust chamber 44 to dilute the exhaust of toxic off-products and to maintain a positive internal pressure to prevent ingress of atmospheric air.

Returning to FIG. 2, it will now be apparent that the several sources of inert gas 52, 60, 65, 74, 78 which communicate with the vertical pyrolysis furnace 22 in addition to the environmental seals 46, 48 provide an effective apparatus to supply and control an inert gaseous atmosphere within the furnace. By suitably adjusting the flow rates of inert gas, such as nitrogen, to the furnace 22, the inert gas is swept upwardly through the central conduit 36 aided by thermally induced free convection.

By adjusting the heating zone 42 such that a continuous length of fibrous material encounters an increasing temperature gradient as it passes through the furnace, the toxic by-products of the furnace are swept away from the fibrous material before it reaches higher temperatures where the by-products will attack and corrode the fibrous material. In addition, the free convection sets up a laminar flow regime within the conduit and thus avoids the deleterious effects of turbulent flow on the continuous length of fibrous material. Turbulent flow exhibits a propensity to increase the rate of corrosion in the fibrous material.

The vertical position of the pyrolysis furnace with the associated free thermal convection currents also is effective to make efficient use of available thermal energy. More specifically, the inert gas entering the bottom convectively transfers heat from the hot lower parts of the furnace to the relatively cooler upper portions thereby making efficient use of thermal energy.

Figure 7:
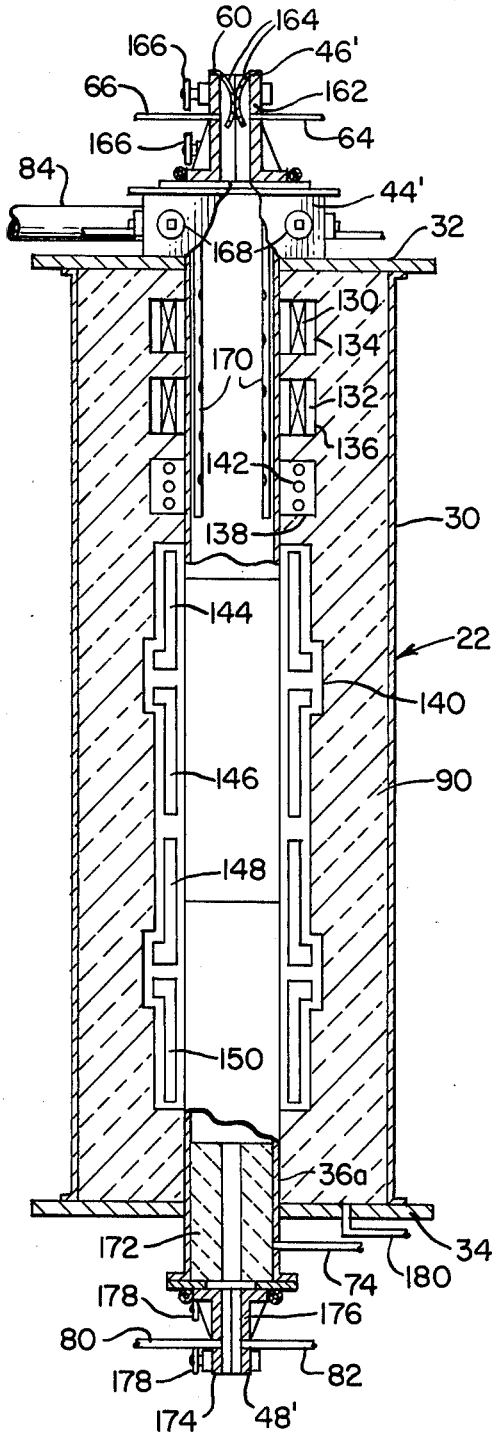
FIG. 7 is a view, siimilar to FIG. 2, illustrating an alternate configuration of heating zones for the pyrolysis furnace.

Turning now to FIG. 7, an alternate construction for the vertical pyrolysis furnace 22 is depicted. A central conduit **36*a*** which may have a rectangular cross section includes a plurality of coaxially disposed tubular sectons of graphite material. The furnace of the alternate embodiment makes possible a greater range of temperatures and an improved control over the temperature profile encountered by a continuous length of fibrous material. As with the embodiment described above, each heating zone of this alternate embodiment may be independently controlled within predetermined limits. However, each heating zone has a pair of opposed heating regions on opposite sides of the conduit.

As the temperature in the first and second heating zones 130, 132 generally does not exceed 1200° C., the first and second heating zones 130, 132 are preferably resistance wound metal heating elements of the type previously described which are inexpensive. If desired, the insulation 90 may include suitable recesses 134, 136, 138, 140 within which the various heating units of the heating zones are disposed.

Spaced axially along the conduit **36*a* from the resistance heating zones is a third heating zone comprising a plurality of suitable conventional silicon carbide heating elements 142.**

Next, the conduit **36*a* is provided with four additional heating zones 144, 146, 148, 150 which are spaced axially from one another in the recess 140 and which are spaced from the third heating zone. Each of the four additional heating zones 144, 146, 148, 150 is provided with a suitable graphite heating element which surrounds the conduit 36*a*.** Graphite is selected for temperatures in the range of 1000° to 3000° C. as it is both durable and inexpensive.

In FIG. 7, the upper seal 46' may comprise a pair of hingedly mounted lips 60, 162 which are mounted on the exhaust chamber 44' in general alignment with the conduit **36*a*. Each lip 60, 162 may be provided with an internally disposed flap 164 which is attached to the upper edge of the corresponding lip. The flaps 164 may be fabricated from polytetrafluroethylene, for example, and are adapted to squeeze the continuous length of fibrous mterial as it passes therebetween to expel entrained air. The lips 60, 162 may be fastened together by suitable conventional clamps 166.**

The exhaust chamber 44' may have a generally rectangular cross section and is preferably provided with as many as eight exhaust ports 168. One or more of the exhaust ports 168 may be connected to the exhaust conduit 84; the ports 168 not so connected may be plugged in a suitable manner.

Passing through the exhaust chamber 44' and into the conduit are a pair of purge lines 170 which may be fabricated of stainless steel and which are provided with openings that permit inert gas to enter the conduit.

At the lower end of the conduit, a radiation shield 172 is provided to inhibit radiant heat from escaping downwardly. Moreover, the radiation shield provides an area in the furnace in which the continuous length of fibrous material may cool before it passes out of the furnace.

The lower environmental seal 48' may also include a pair of hingedly mounted lips 174, 176 that are clamped together by suitable conventional clamps 178. In addition an inert gas purge line 180 may communicate with the gas-tight shell 30.

In operation of the furnace 22 according to either embodiment, a suitable supply of pressurized inert gas is supplied to the opening 104 in the upper and lower environmental seals 46, 48 (see FIG. 2). The gas has a pressure sufficiently greater than ambient pressure so that a flow of fresh inert gas passes outwardly through the space 104 to prevent the atmospheric gases from entering into the space 104 along the length of fibrous material. Simultaneously, the gas in the space 104 prevents gaseous by-products from escaping by a similar gas-curtain effect.

As the continuous length of fibrous material passes vertically downwardly through the conduit 36 (see FIG. 2) the fibrous material encounters a vertically downwardly increasing temperature gradient which is made possible by the plurality of spaced heating zones 42 provided circumferentially around the conduit means 36. Moreover, due to the balanced supply of inert gas, the continuous length of fibrous material encounters a decreasing concentration gradient of by-product gases driven off by the heating while moving downwardly through the pyrolysis furnace 22.

It should now be apparent to those skilled in the art that a vertical pyrolysis furnace, constructed in accordance with the present invention, exhibits numerous advantages not heretofore available in pyrolysis furnaces. One advantage concerns the available control of temperature gradient sensed by a continuous length of fibrous material passing through the furnace.

Another advantage resides in the decreasing concentration of by-product gases encountered by the continuous length of fibrous material as it passes through the furnace.

A further advantage relates to the efficient utilization of heating energy by convectively transferring the energy to cooler portions of the furnace for further use in heating. A related facet of the invention is the maintenance of a laminar flow regime for the gaseous atmosphere which moves upwardly through the furnace under the influence of free thermal convection.

By providing an unobstructed central conduit having a large exhaust chamber at the top to collect and discharge exhaust gases, the present invention advantageously reduces the condensation of tar-like substances in the furnace.

The vertical orientation of the pyrolysis furnace is also advantageously effective to eliminate catenary controls, to improve utilization of available floor space, and to facilitate the ease with which the furnace may be strung-up.

While numerous other advantages will also be apparent to those skilled in the art, it will now be apparent that there has been provided in accordance with the present invention an improved vertical pyrolysis furnace which substantially satisfies the objects and advantages set forth above. Moreover, it will be apparent to those skilled in the art that many modifications, variations, substitutions and equivalents may be provided for the elements of the apparatus as disclosed above. It is therefore expressly intended that all such variations, modifications, substitutions and equivalents as fall within the invention as described in the appended claims be embraced thereby.

What is claimed is:

1. In an apparatus for the continuous production of carbon fibers via thermal processing having a stabilization furnace and an improved pyrolysis furnace for pyrolyzing a continuous length of stabilized fibrous material in an inert gaseous atmosphere after treatment in the stabilization furnace, the pyrolysis furnace comprising:

conduit means having an inlet end, an outlet end, operable to receive a continuous length of stabilized fibrous material, and operable to function in a generally vertical posture such that the inlet end is vertically above the outlet end;

a plurality of heating zones longitudinally positioned along the conduit means, being independently controlled so that a predetermined temperature profile may be obtained and being operable to transfer heat to a continuous length of stabilized fibrous material passing downwardly through said conduit means;

insulation means surrounding the plurality of heating zones and the conduit means and operable to minimize heat loss to the environment;

exhaust means having a fiber inlet and a chamber with physical dimensions exceeding the lateral extent of the conduit means, being in fluid communication with the inlet end of the conduit means, and operable to receive toxic gaseous by-products from the conduit means;

environment protecting seal means provided at the fiber inlet of the exhaust means and at the conduit outlet and being operable to prevent toxic gaseous by-products from escaping to the environment while preventing environmental oxygen from entering the pyrolysis furnace; and inert atmosphere control means communicating with the seal means, the inlet end, and the outlet end of the conduit means and being operable to maintain an inert gaseous atmosphere in the furnace while convectively sweeping toxic gaseous by-products from the conduit means to the exhaust means.

2. The apparatus of claim 1 wherein each heating zone of the pyrolysis furnace includes:

resistance heating means peripherally disposed about the conduit means and operable to transfer heat to the conduit means; and thermally responsive control means for sensing a temperature of the inert gaseous atmosphere and adjusting the resistance heaing means to keep the sensed temperature within predeteremined limits.

3. The apparatus of claim 2 wherein at least one resistance heating means comprises four resistance heaters mounted in ceramic blocks and arranged in quadrilateral configuration around the conduit means.

4. The apparatus of claim 1 wherein the conduit means of the pyrolysis furnace comprises a metal tube having a generally circular cross section and a diameter substantially exceeding the lateral extent of the continuous length of fibrous material.

5. The apparatus of claim 1 wherein the conduit means of the pyrolysis furnace comprises a grahite tube having a generally circular cross section and a diameter substantially exceeding the lateral extent of the continuous length of fibrous material.

6. The apparatus of claim 1 wherein the atmosphere control means of the pyrolysis furnace includes a gas heater for heating a portion of the inert gas communicating with the inlet seal means.

7. A pyrolysis oven for pyrolyzing a continuous length of a stabilized fibrous mterial in an inert gaseous atmosphere as the fibrous material passes through the oven, comprising:

a gas-tight shell having a central axis, a top opening aigned with the axis, and a bottom opening aligned with the axis;

conduit means having an inlet end, an outlet end, being operable to receive a continuous length of stabilized fibrous material, and internally disposed with respect to the shell so that the inlet is aligned with the top opening and the outlet is aligned with the bottom opening;

a plurality of independently controlled heating zones longitudinally positioned externally along the conduit means, and being operable to transfer heat to a continuous length of stabilized fibrous material in accordance with a predetermined temperature profile;

insulation means surrounding the plurality of heating zones and the conduit means to reduce heat loss to the environment;

exhaust means having a fiber inlet aligned with the top opening and a chamber with lateral physical dimensions exceeding the lateral extent of the conduit means and being operable to receive toxic gaseous products from the conduit means;

environmental sealing means provided at the fiber inlet and the bottom opening operable to prevent toxic gaseous products from escaping to the environment; and inert atmosphere control means communicating with the inlet end and the outlet end of the conduit means and operable to induce a flow of inert gas from the outlet end to the exhaust means.

8. The pyrolysis oven of claim 7 wherein each heating zone includes:

resistance heating means peripherally disposed about the conduit means and operable to transfer heat to the conduit means; and thermally responsive control means for sensing a temperature of the atmosphere within the conduit means and adjusting the corresponding resistance heating means to keep the sensed temperature within predetermined limits.

9. The pyrolysis oven of claim 7 wherein:

the inert atmosphere control means communicates with the environmental sealing means; and the environmental sealing means includes a fixed lip member haing an internal manifold intersected by a plurality of discharge openings that communicate with a surface thereof, a movable lip member hingedly connected to a side of the fixed lip member, having an internal manifold intersected by a plurality of discharge openings that communicate with a surface thereof, the surface of the movable lip member being adjacent to and spaced from the surface of the fixed lip member such that discharge openings are aligned and a space is defined for the passage of a continuous length of fibrous material, latching means carried by the fixed lip member and operable to engage the movable lip member to hold the surfaces in proper spaced relationship, and fluid connections between the inert atmosphere control means and the manifolds such that pressurized inert gas may be supplied to flood the space and prevent the passage of environmental air therethrough.

10. A vertical pyrolysis oven for pyrolyzing a continuous length of stabilized fibrous material in an inert gaseous atmosphere as the continuous length of stabilized fibrous material moves through the oven comprising:

a gas-tight shell having a top with an opening, a bottom with an opening and a generally vertical axis;

a conduit having an inlet aligned with the top opening, an outlet aligned with the bottom opening and a diameter substantially exceeding the lateral extent of the continuous length of fibrous material;

exhaust means mounted on the top, having an inlet opening aligned with the top opening, an exhaust port, a chamber that is substantially wider than the continuous length of fibrous material and operable to collect toxic gaseous products for discharge through the exhaust port;

a top seal mounted on the exhaust means at the inlet opening and operable to prevent environmental air from entering the oven and to prevent toxic gaseous products from escaping to the environmental air while allowing a continuous length of stabilized fibrous material to enter the oven;

a bottom seal aligned with the bottom opening and operable to prevent environmental air from entering the oven and to prevent toxic gaseous products from escaping to the environmental air while allowing a continuous length of stabilized fibrous material to leave the oven;

a plurality of independently controlled heating zones spaced externally along the conduit and being operable to provide a temperature profile in the conduit which increases vertically downwardly;

insulation surrounding the conduit and the heating zones within the shell; and inert atmosphere control means in fluid communication with the top seal, the bottom seal, the upper end of the conduit and the lower end of the conduit and operable to sweep toxic gaseous products thermally driven from a downwardly moving continuous length of stabilized fibrous material, the gaseous products moving upwardly under the influence of free convection.

11. The vertical pyrolysis oven of claim 10 wherein seven heating zones are provided which peripherally surround the conduit at least one heating zone includes resistance heating elements.

12. The vertical pyrolysis oven of claim 11 wherein eight heating zones are provided and each zone includes resistance heating elements peripherally disposed around the conduit.

13. The vertical pyrolysis oven of claim 11 including a silicon carbide heating zone and a plurality of graphite heating element zones.

14. The vertical pyrolysis furnace of claim 10 wherein the top seal and the bottom seal are flooded with inert gas to prevent toxic gaseous products from escaping and to prevent environmental gases from entering while permitting a continuous length of fibrous material to move continuously therethrough.

15. The vertical pyrolysis furnace of claim 10 wherein the exhaust means communicates with toxic gas treatment means.

* * * * *